US007141012B2

(12) United States Patent
Lin

(10) Patent No.: US 7,141,012 B2
(45) Date of Patent: Nov. 28, 2006

(54) EXERCISING DEVICE HAVING A BALL BODY

(75) Inventor: William Lin, Taichung (TW)

(73) Assignee: Asia Regent Limited, Taichung (TW)

( * ) Notice: Subject to any disclaimer, the term of this patent is extended or adjusted under 35 U.S.C. 154(b) by 245 days.

(21) Appl. No.: 10/682,235

(22) Filed: Oct. 9, 2003

(65) Prior Publication Data

US 2005/0079963 A1 Apr. 14, 2005

(51) Int. Cl.
*H63B 21/00* (2006.01)

(52) U.S. Cl. ..... 482/726; 482/121; 482/124

(58) Field of Classification Search ..... 482/74, 482/121–130, 140, 142
See application file for complete search history.

(56) References Cited

U.S. PATENT DOCUMENTS 5,205,803 A * 4/1993 Zemitis ..... 482/121
5,518,481 A * 5/1996 Darkwah ..... 482/126
5,735,776 A * 4/1998 Swezey et al. ..... 482/91
6,702,726 B1 * 3/2004 Lin ..... 482/148
D503,756 S * 4/2005 Chiang ..... D21/662

* cited by examiner

*Primary Examiner*—Jerome Donnelly
(74) *Attorney, Agent, or Firm*—Ohlandt, Greeley, Ruggiero & Perle, L.L.P.

(57) ABSTRACT

An exercising device includes a ball body having a peripheral wall and a receiving space, a predetermined volume of filler, and two pulling units. The peripheral wall has a largest diameter not larger than 12 inches, a filling hole in fluid communication with the receiving space, at least two ear portions protruding outwardly from an outer wall surface of the peripheral wall, and a valve member inserted detachably into the filling hole. The filler is introduced into the receiving space through the filling hole. Each pulling unit includes an elastic cord member having a connecting end connected to a respective one of the ear portions and an operating end opposite to the connecting end, and a handgrip connected to the operating end of the cord member.

5 Claims, 15 Drawing Sheets

EXERCISING DEVICE HAVING A BALL BODY

BACKGROUND OF THE INVENTION

1. Field of the Invention

The invention relates to an exercising device, more particularly to a ball-shaped rhythmic exercising device.

2. Description of the Related Art

There are various kinds of exercising devices available in the market today, an example of which is a flexible rod exerciser shown in FIG. 1. The rod exerciser includes an elongate main rod body 1, a handgrip 2 connected fixedly to an intermediate portion of the main rod body 1, and two counterweight units 3 connected fixedly and respectively to two opposite ends of the main rod body 1.

In use, the user grasps the handgrip 2 and applies a force to the flexible rod exerciser in upward and downward or leftward and rightward directions. As a result, the main rod body 1 produces repeated vibrations so as to vibrate the arm muscles of the user, thereby achieving body exercise.

Although the flexible rod exerciser can achieve its intended purpose, it is limited to exercising only the hand portion of the user, especially the effective training of the arm muscles, so that the exercising range of the flexible rod exerciser is limited. Moreover, the weight of the counterweight units 3 cannot be adjusted so as to suit the requirement of the user.

SUMMARY OF THE INVENTION

Therefore, the object of the present invention is to provide a ball-shaped rhythmic exercising device that is suitable for exercising different body parts of the user, that produces various exercising forms, and that has adjustable counterweights.

According to this invention, a ball-shaped rhythmic exercising device comprises a ball body, a predetermined volume of filler, and two pulling units. The ball body is made of a resilient deformable material, and has a peripheral wall and a receiving space defined by the peripheral wall. The peripheral wall has a largest diameter not larger than 12 inches, an inner wall surface adjacent to the receiving space, an outer wall surface opposite to the inner wall surface, a filling hole extending from the outer wall surface to the inner wall surface and in fluid communication with the receiving space, at least two ear portions protruding outwardly from the outer wall surface, and a valve member inserted detachably into the filling hole to prevent leakage through the filling hole. The filler is introduced into the receiving space through the filling hole. Each of the pulling units includes an elastic cord member that has a connecting end connected to a respective one of the ear portions and an operating end opposite to the connecting end, and a handgrip connected to the operating end of the cord member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
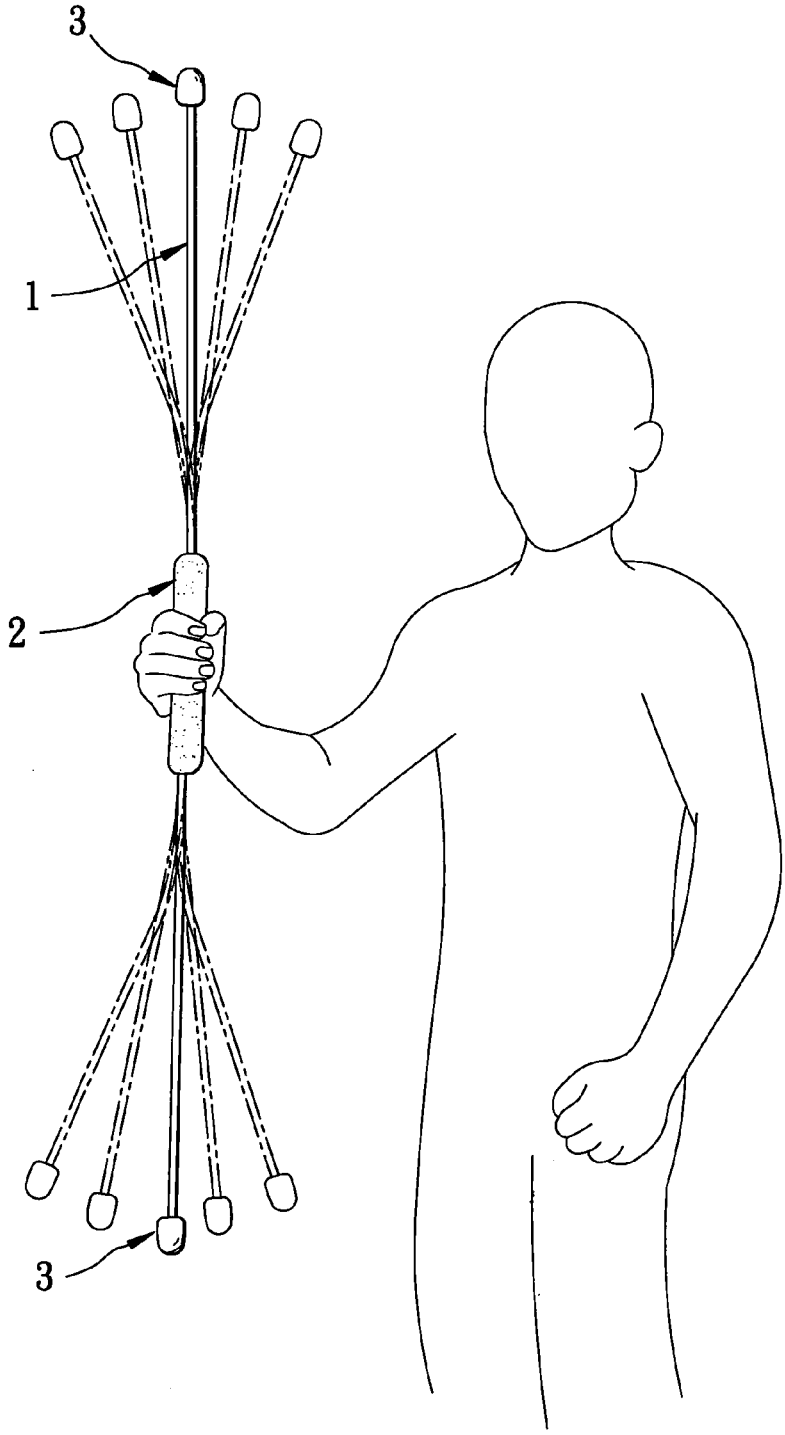
FIG. 1 PRIOR ART
FIG. 1 is a perspective view of a currently available flexible rod exerciser.
Figure 2:
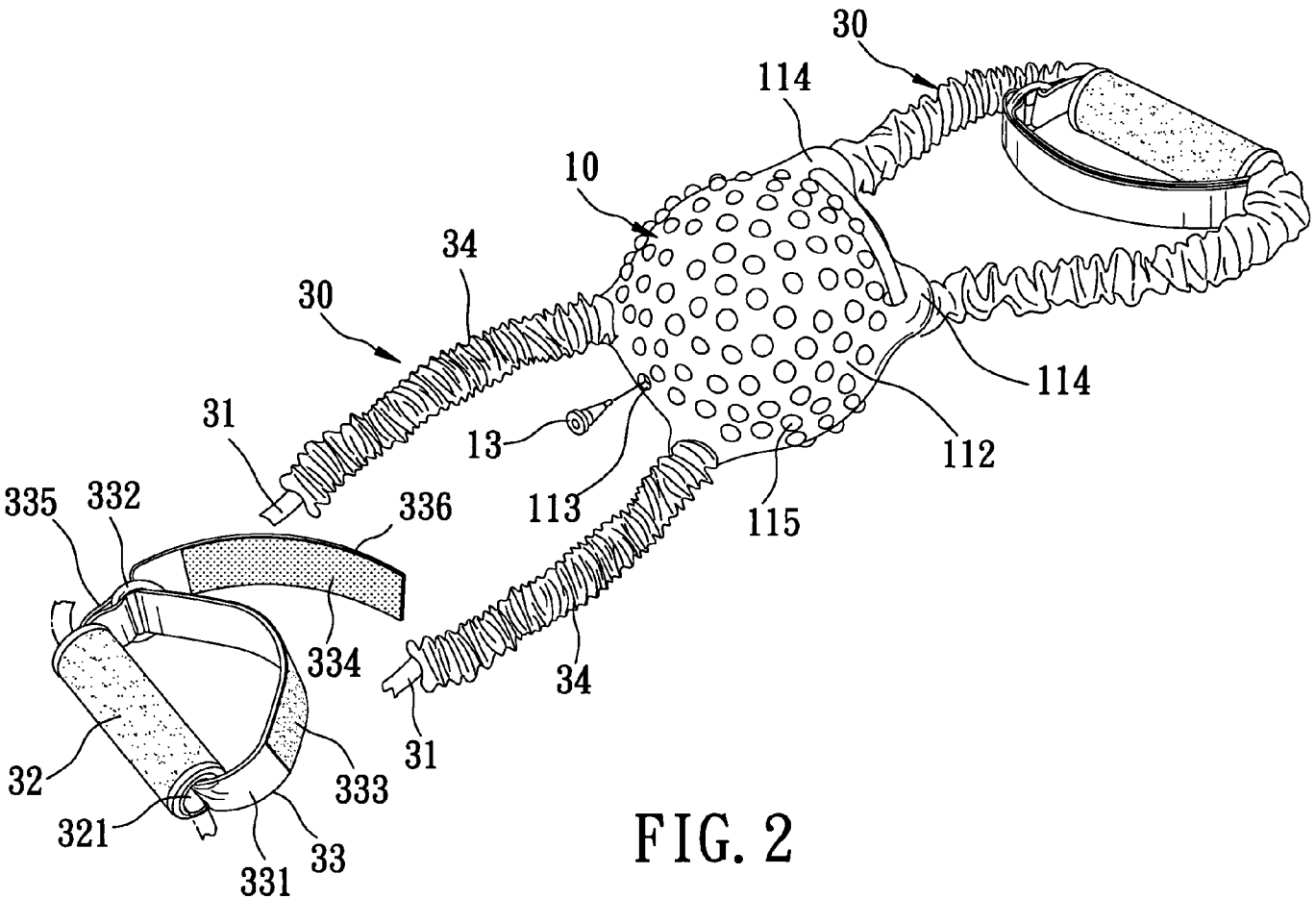
FIG. 2 is a fragmentary perspective view of the preferred embodiment of a ball-shaped rhythmic exercising device according to the present invention.
Figure 3:
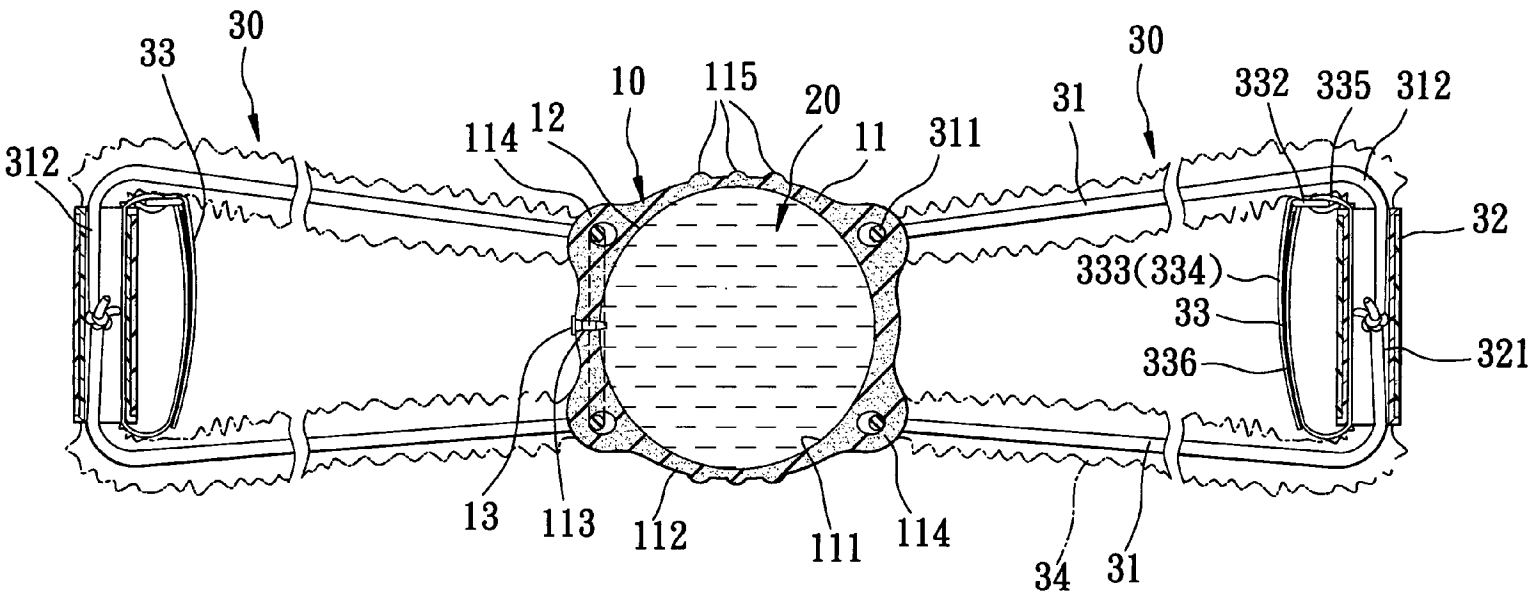
FIG. 3 is a sectional view of the preferred embodiment in an assembled state.

Referring to FIGS. 2 and 3, the preferred embodiment of a ball-shaped rhythmic exercising device according to the present invention is shown to comprise a ball body 10, a predetermined volume of filler 20 disposed inside the ball body 10, and two pulling units 30 connected respectively to two opposite sides of the ball body 10.

The ball body 10 is made of a resilient deformable material, such as rubber or plastic, and has a peripheral wall 11, and a receiving space 12 defined by the peripheral wall 11. The largest diameter of the peripheral wall 11 is not larger than 12 inches. The peripheral wall 11 has an inner wall surface 111 adjacent to the receiving space 12, an outer wall surface 112 opposite to the inner wall surface 111, a filling hole 113 extending from the outer wall surface 112 to the inner wall surface 111 and in fluid communication with the receiving space 12, two pairs of ear portions 114 protruding outwardly and respectively from two opposite sides of the outer wall surface 112, and a valve member. A plurality of massage projections 115 are formed on the outer wall surface 112. In this embodiment, the valve member is formed as a plug 13. The plug 13 is tapered, and is inserted detachably into the filling hole 113 so as to prevent leakage through the filling hole 113. As such, the receiving space 12 is sealed completely.

In this embodiment, the filler 20 can be sand, air, liquid, or a mixture of any two of these filling materials, and is introduced into the receiving space 12 through the filling hole 113.

Each of the pulling units 30 includes a pair of elastic cord members 31, a handgrip 32, a positioning strap 33, and a pair of fabric covers 34. Each of the elastic cord members 31 has a connecting end 311, and an operating end 312 opposite to the connecting end 311. In this embodiment, the connecting ends 311 of the cord members 31 are connected integrally, and pass respectively through through holes in an adjacent pair of the ear portions 114. The operating ends 312 of the cord members 31 are tied together to form a knot.

The handgrip 32 is connected to the operating ends 312 of the respective cord members 31. The handgrip 32 is tubular in shape, and has a through hole 321 for hiding therein the knot of the operating ends 312.

The positioning strap 33 is connected adjustably to the handgrip 32, and is a continuous strap piece having a first end 335, a second end 336 opposite to the first end 335, and an intermediate section 331 between the first and second ends 335, 336. A ring member 332 is connected to the first end 335. A first fastening unit 334, such as a male Velcro fastener, is connected fixedly to the second end 336. A second fastening unit 333, such as a female Velcro fastener, is connected fixedly to the intermediate section 331. The positioning strap 33 is inserted into the through hole 321 in the handgrip 32 in such a manner that the ring member 332 and the first and second fastening units 334, 333 are disposed outside of the handgrip 32. The second end 336 extends through the ring member 332, and is folded back to the intermediate section 331 so that the first and second fastening units 334, 333 can be inter-engaged.

Each of the fabric covers 34 covers the respective cord member 31. The total length of each fabric cover 34 is longer than the free length of the corresponding cord member 31. Under normal circumstances, the fabric covers 34 are sleeved respectively on the cord members 31, and are squeezed between the handgrip 32 and the ear portions 114.

Referring back to FIG. 3, the ball body 10 is connected to and is disposed between the pulling units 30. A predetermined volume and type of the filler 20 is introduced into the receiving space 12 through the filling hole 113, after which the plug 13 is inserted into the filling hole 113 and seals the same. As such, the peripheral wall 11 of the ball body 10 is expanded to form a ball-shaped body, which can return to a normal shape after being pressed. When the filler 20 is sand or liquid, the ball body 10 contains a relative weight which can be adjusted so as to suit the exercise requirement of the user. When the second end 336 of each positioning strap 33 is folded back to the intermediate section 331 after passing through the ring member 332, the first and second fastening units 334, 333 can be attached and detached as necessary and can be adjusted according to the body type of the user.

Figure 4:
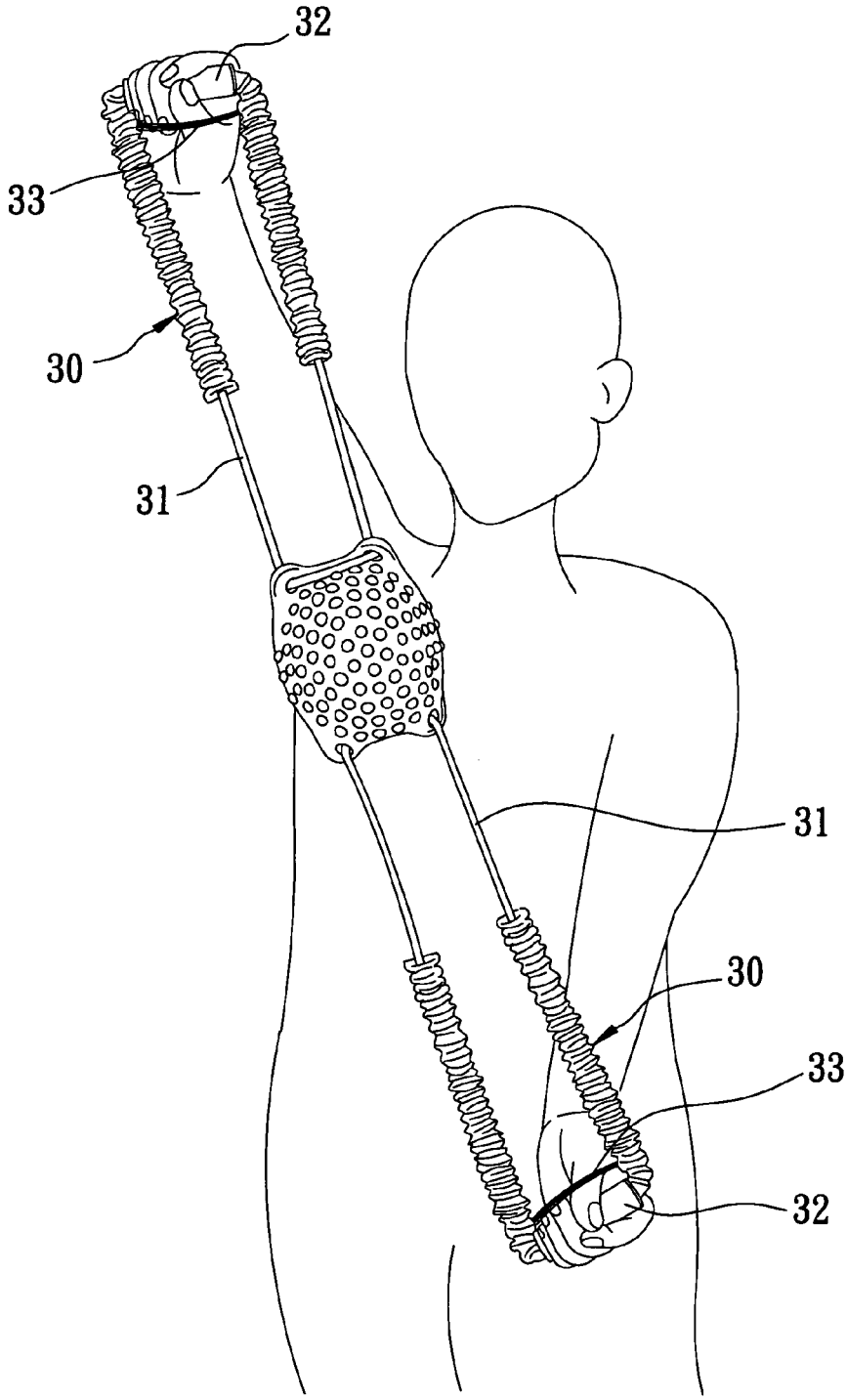
FIGS. 4 to 15 illustrate a series of exercises that can be performed using the preferred embodiment.

Thus, the following exercises can be performed using the preferred embodiment of the present invention:

1. Referring to FIG. 4, both hands of the user are placed respectively on the handgrips 32. Each positioning strap 33 winds around and ties one hand of the user to the corresponding handgrip 32 so that unnecessary loosening of the user's hands from the handgrips 32 can be prevented, thereby enhancing safety. When both arms of the user stretch the pulling units 30 in opposite upward and downward directions until the arms are straight, the arms have to exert dragging forces to resist the restoring forces of the cord members 31 so that training of the muscles of the user's arms can be achieved.

Figure 5:
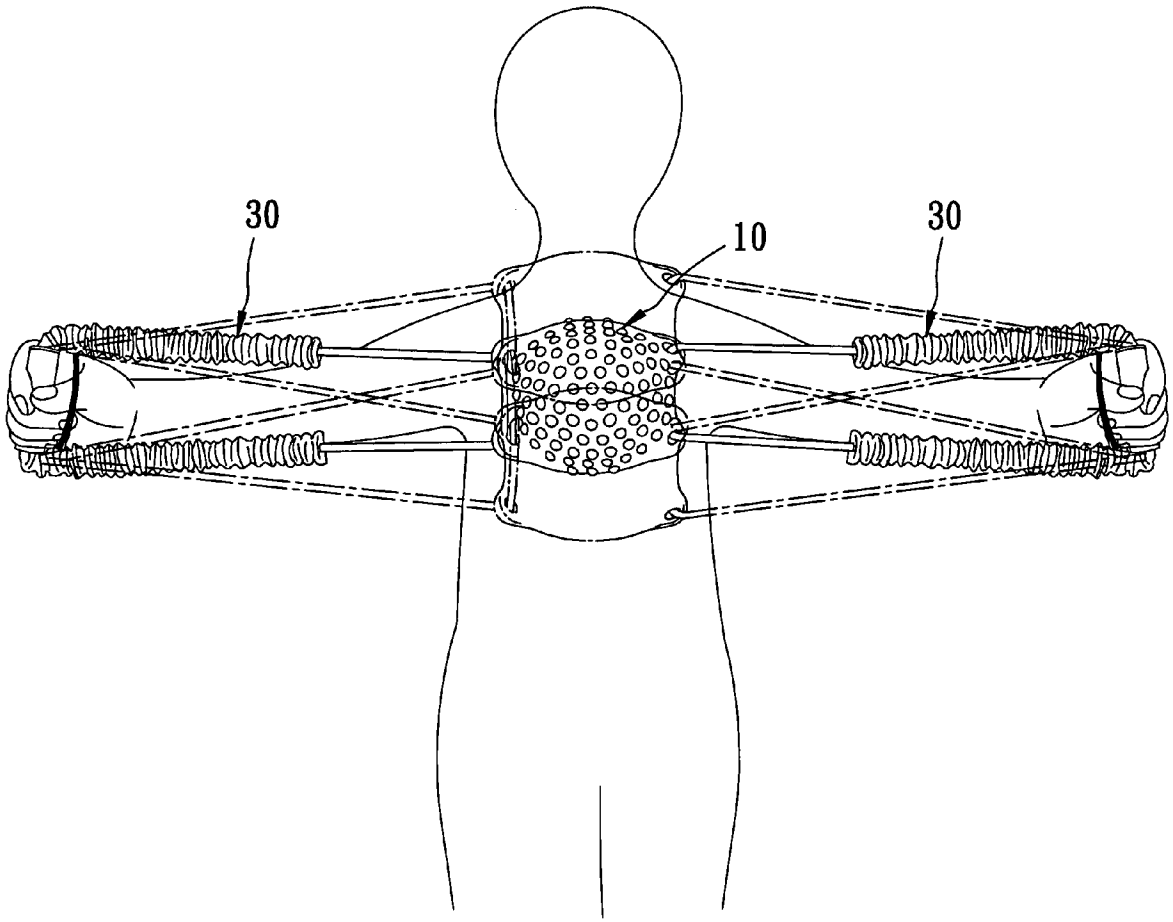

2. The exercise shown in FIG. 5 is substantially similar to the exercise shown in FIG. 4. However, in this exercise, the arms of the user stretch the pulling units 30 in opposite leftward and rightward directions until the arms are straight and exert forces so as to vibrate repeatedly the ball body 10 in upward and downward directions so that exercising of the muscles of the user's arms can be attained.

Figure 6:
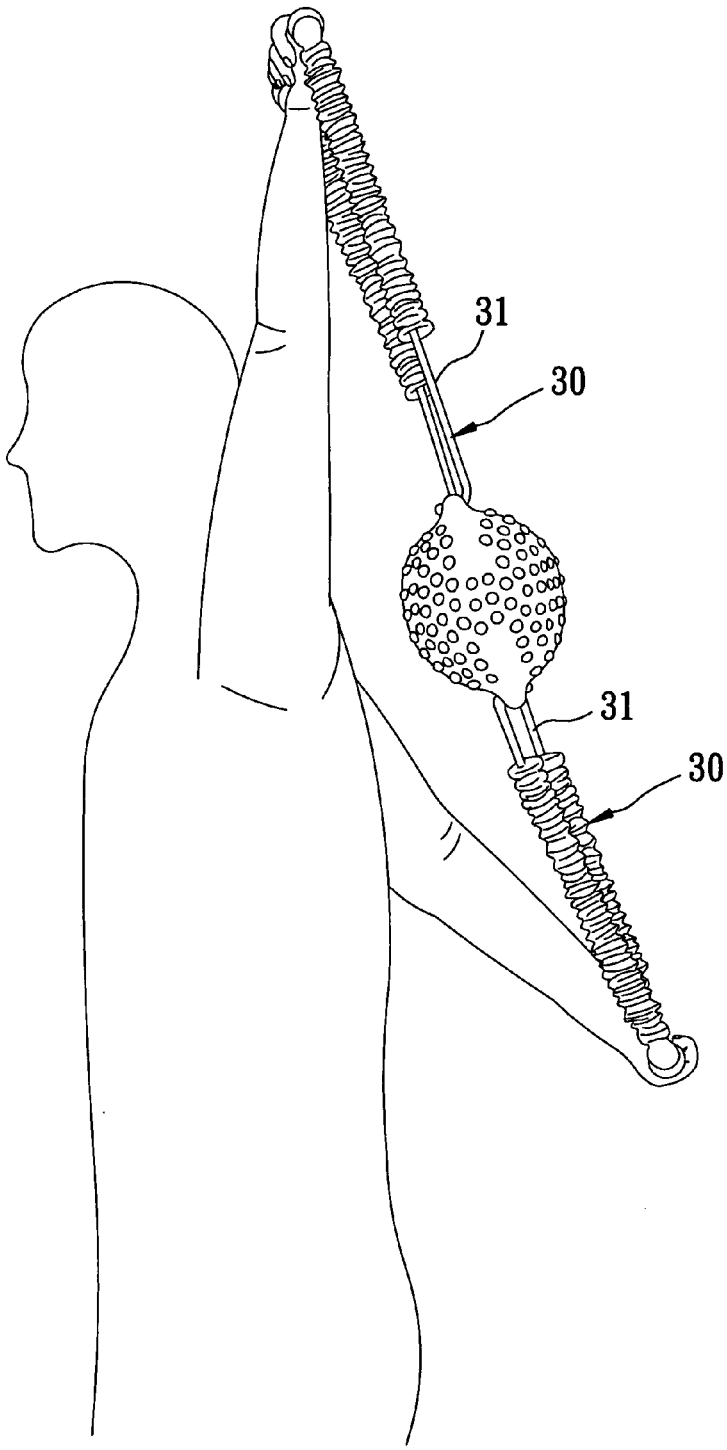

3. Referring to FIG. 6, when the user places the exercising device of the present invention at his back, and uses both arms to stretch the pulling units 30 in opposite outward directions until the arms are straight, stretching and chest expanding exercise are effected in this exercise.

Figure 7:
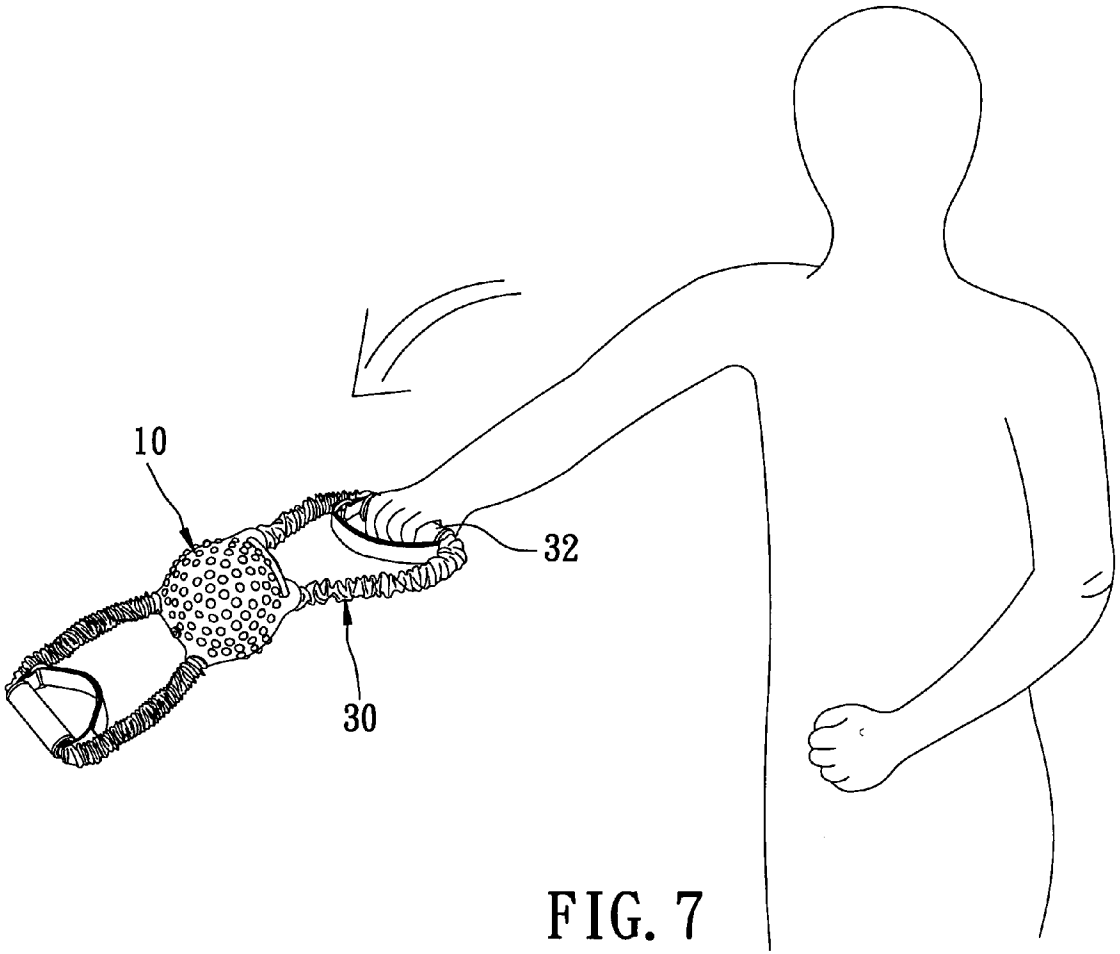

4. Referring to FIG. 7, after the ball body 10 is filled with sand or liquid, the user uses a single hand to grasp one of the handgrips 32 and starts exercising by flinging the ball body 10 outwardly. Because of the elasticity of the pulling units 30 and the weight of the ball body 10, training of the strength and muscles of the arm can be achieved.

Figure 8:
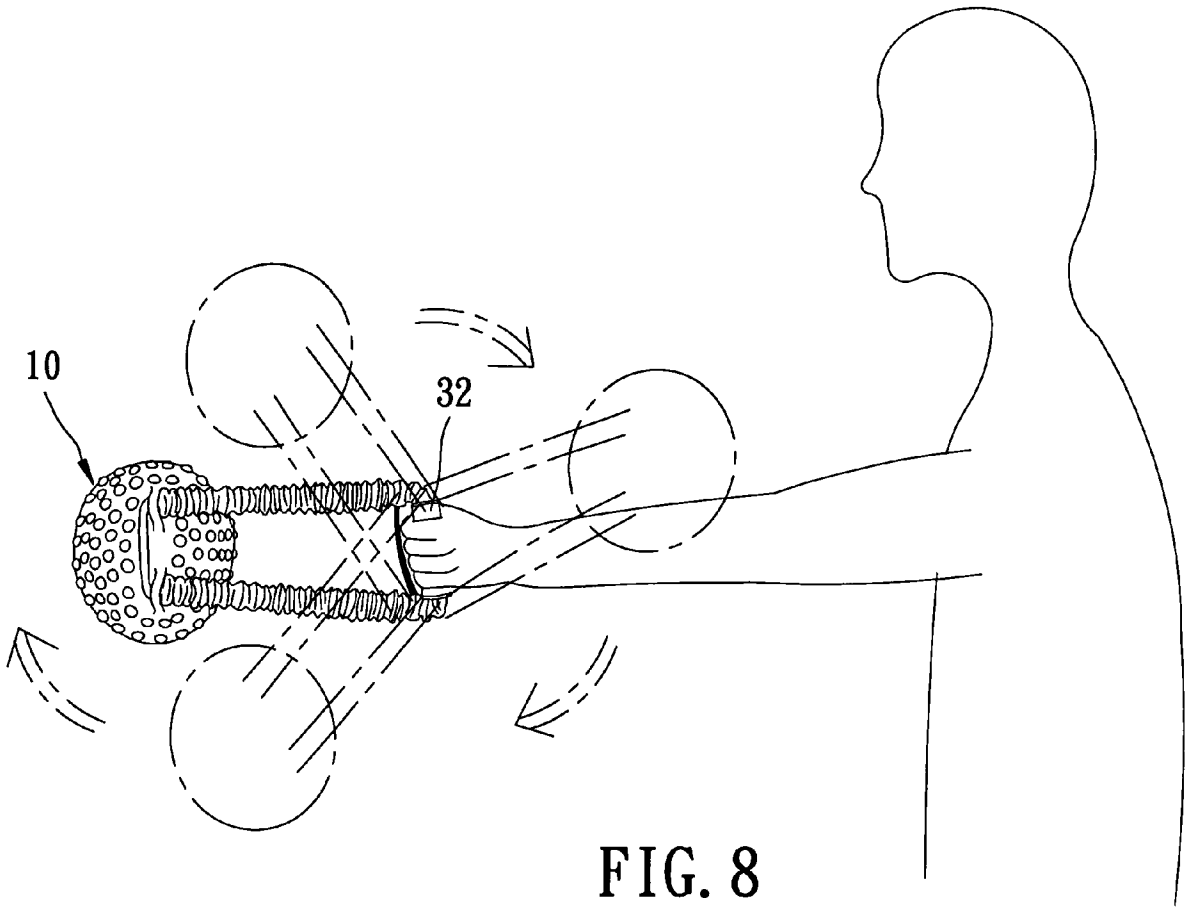

5. The exercise shown in FIG. 8 is substantially similar to the exercise shown in FIG. 7. However, in this exercise, the user grasps the two handgrips 32 with one hand, and rotates the ball body 10 so that the ball body 10 is subjected to a centrifugal force and produces an inertial rotational force, thereby achieving exercise of the user's arm.

Figure 9:
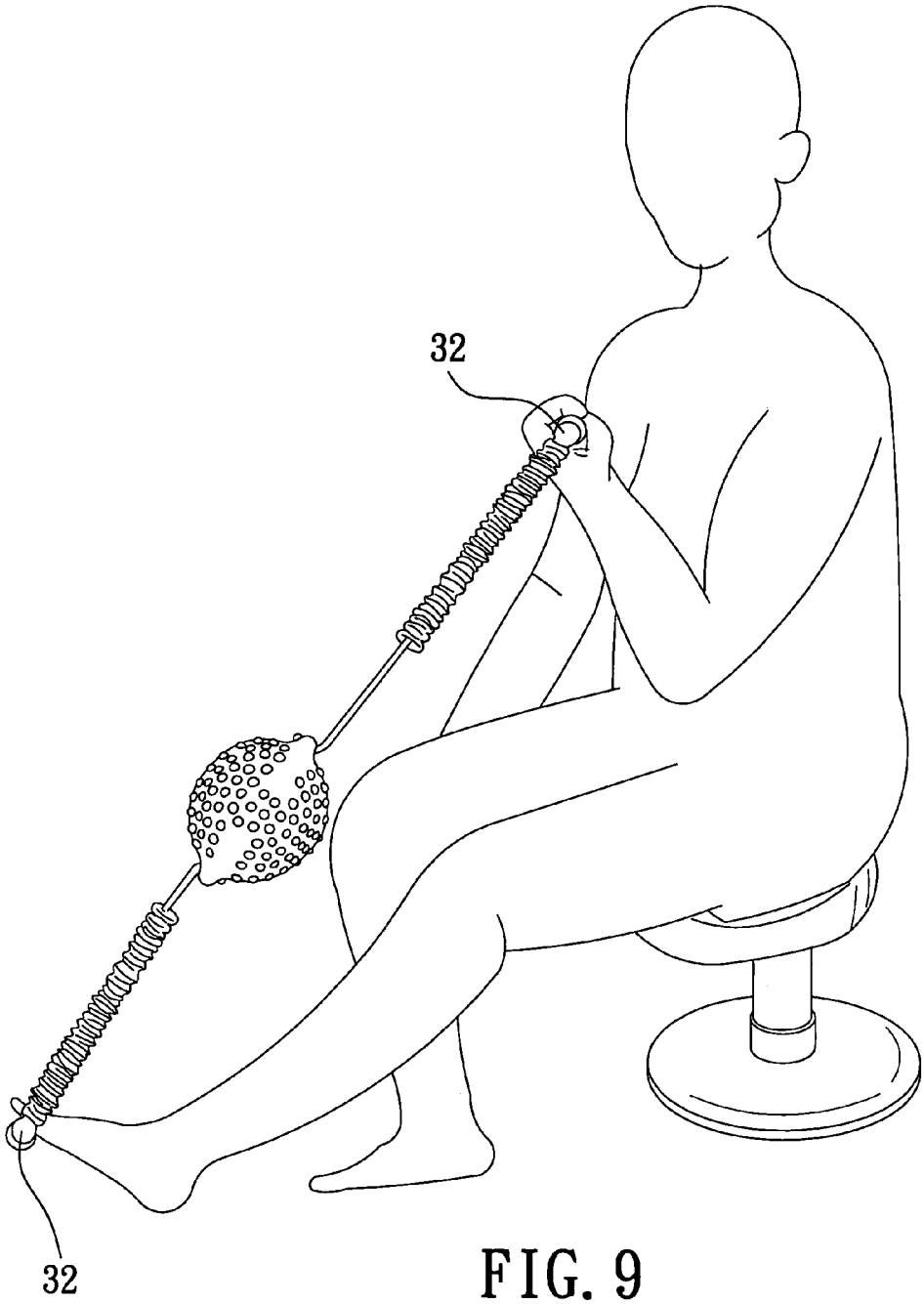

6. Referring to FIG. 9, the user is seated, hooks one of the handgrips 32 on one foot, and grasps the other handgrip 32 with one hand. Exercise is performed by pulling the hand and the foot in opposite directions. As such, simultaneous exercise of the foot and the hand of the user can be achieved.

Figure 10:
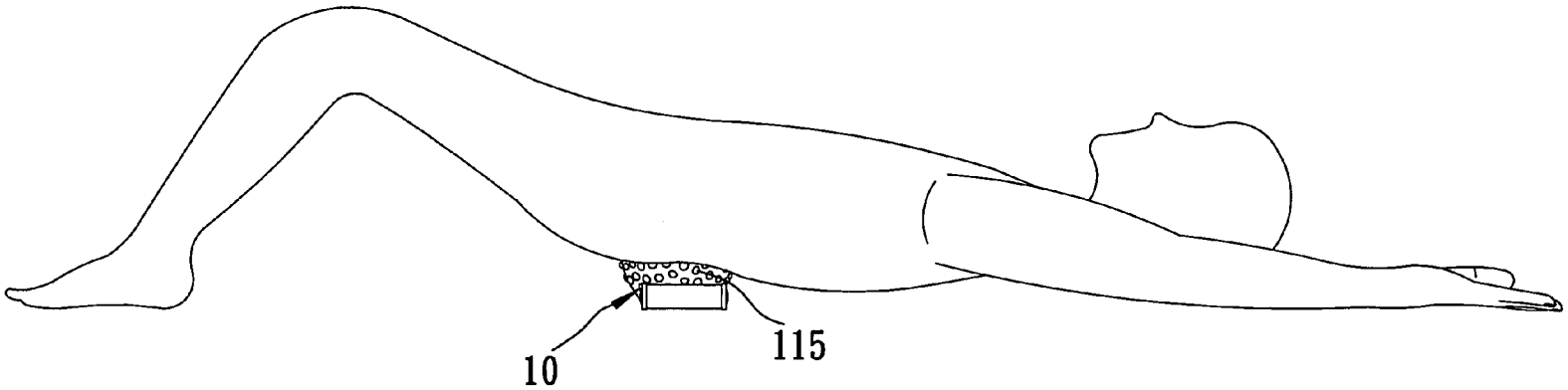

7. Referring to FIG. 10, when the user lies down on the floor with the ball body 10 placed under his waist portion and performs frontward and rearward movements, a massaging action can be effected on the waist portion through the presence of the massage projections 115 on the ball body 10. In this kind of exercise, the ball body 10 is suitably filled with air, liquid, a mixture of air and liquid, or a mixture of air and sand, so that the ball body 10 has a deformable elasticity.

Figure 11:
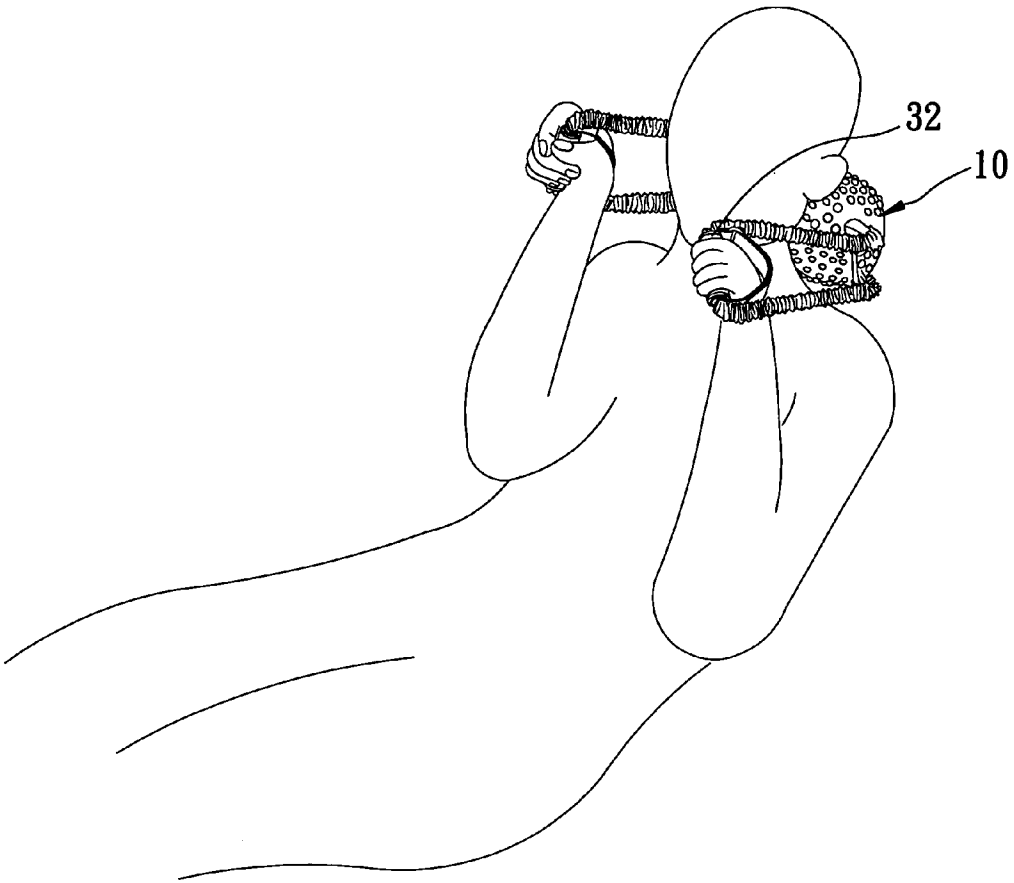

8. Referring to FIG. 11, when the user sits on the floor and places the ball body 10 at the back of his/her neck portion with both hands grasping respectively the handgrips 32, the user can start performing a sit-up exercise so as to achieve training of the stomach muscles. In this kind of exercise, the ball body 10 is suitably filled with air, liquid, a mixture of air and liquid, or a mixture of air and sand, so that the ball body 10 has a deformable elasticity.

Figure 12:
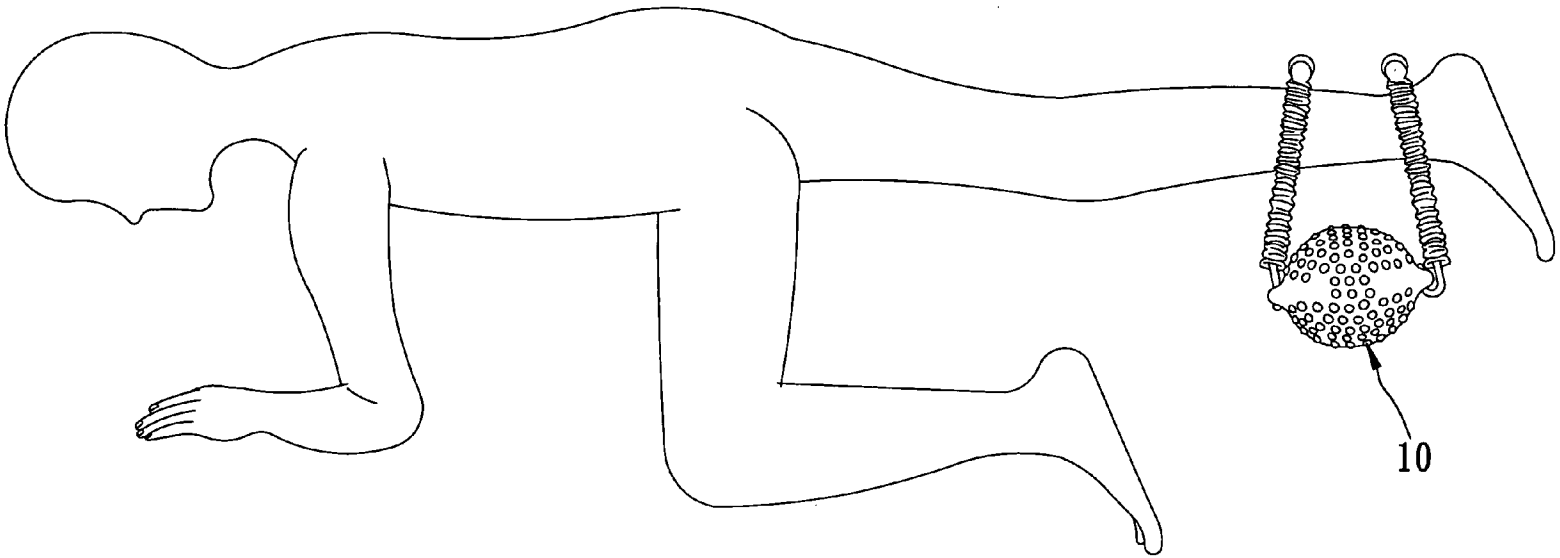

9. Referring to FIG. 12, the user lies in a prostrate position on the floor with propping arms, with one bended knee, and with one outstretched foot. After the ball body 10 is filled with sand or liquid so as to have a relative weight, the exercising device of the present invention is hung on the outstretched foot of the user, after which the user starts exercising by lifting the loaded leg so as to achieve raising the user's buttocks and building the leg strength of the user.

Figure 13:
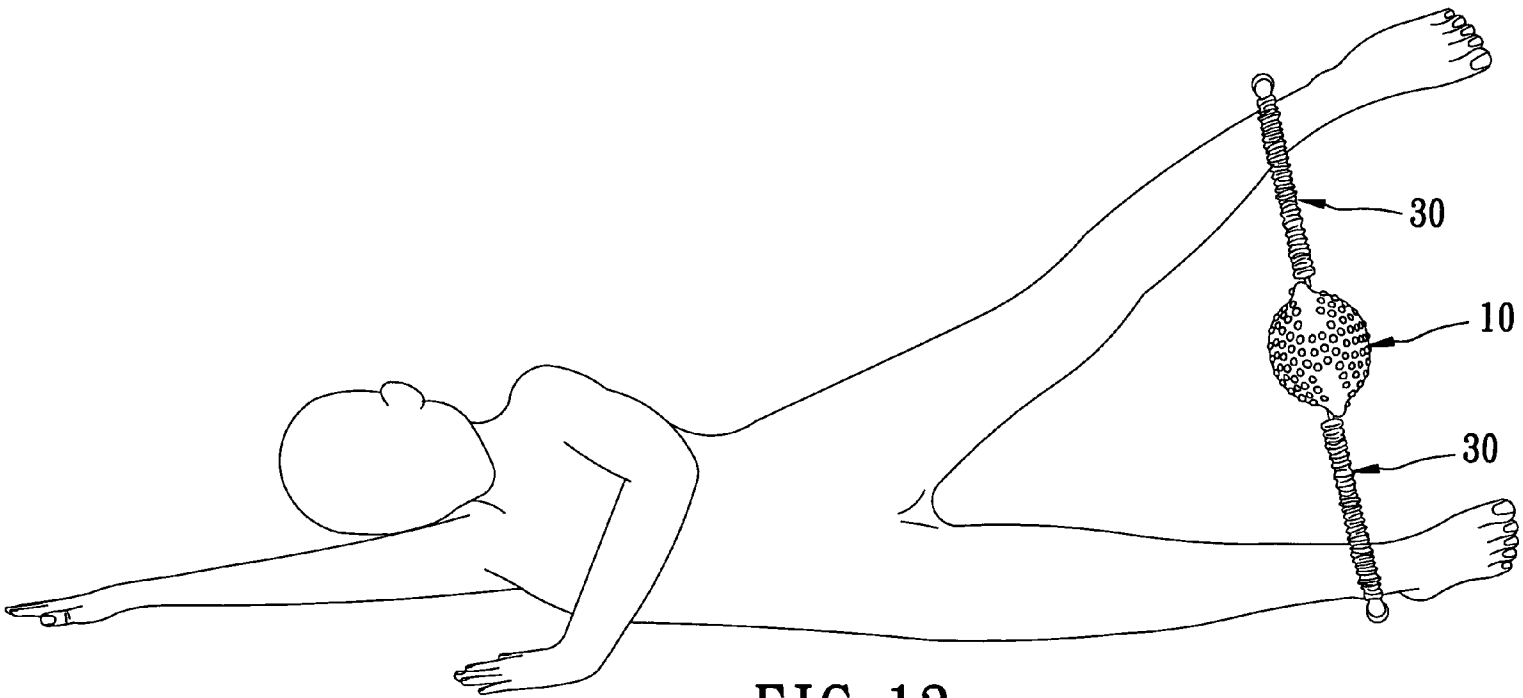

10. Referring to FIG. 13, when the user lies sideward on the floor with the pulling units 30 disposed respectively on the user's feet so that the ball body 10 is disposed between the pulling units 30, the user can repeatedly perform opening and closing of the feet so as to build the leg strength and to sculpt the legs of the user.

Figure 14:
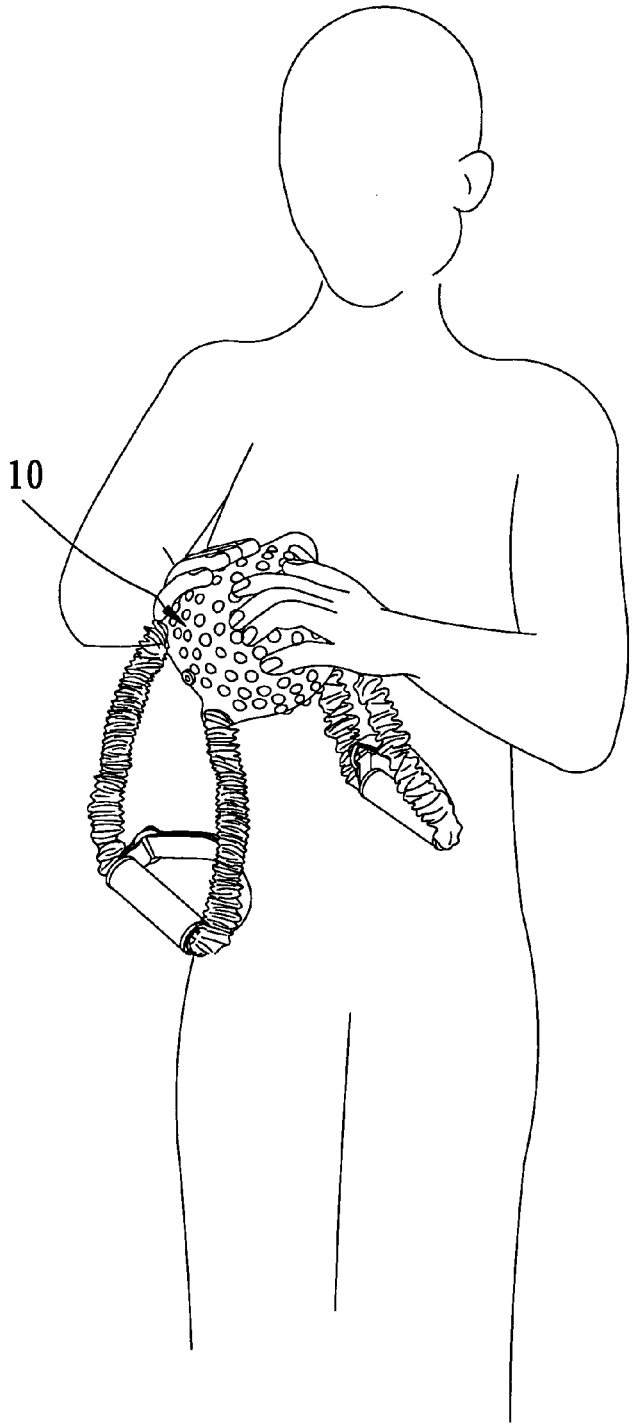

11. Referring to FIG. 14, when the user directly kneads the ball body 10 with two hands, massaging of the hand portions and training of the flexibility of the fingers can be achieved. In this kind of exercise, the ball body 10 is suitably filled with air, liquid, a mixture of air and liquid, or a mixture of air and sand, so that the ball body 10 has a deformable elasticity.

Figure 15:
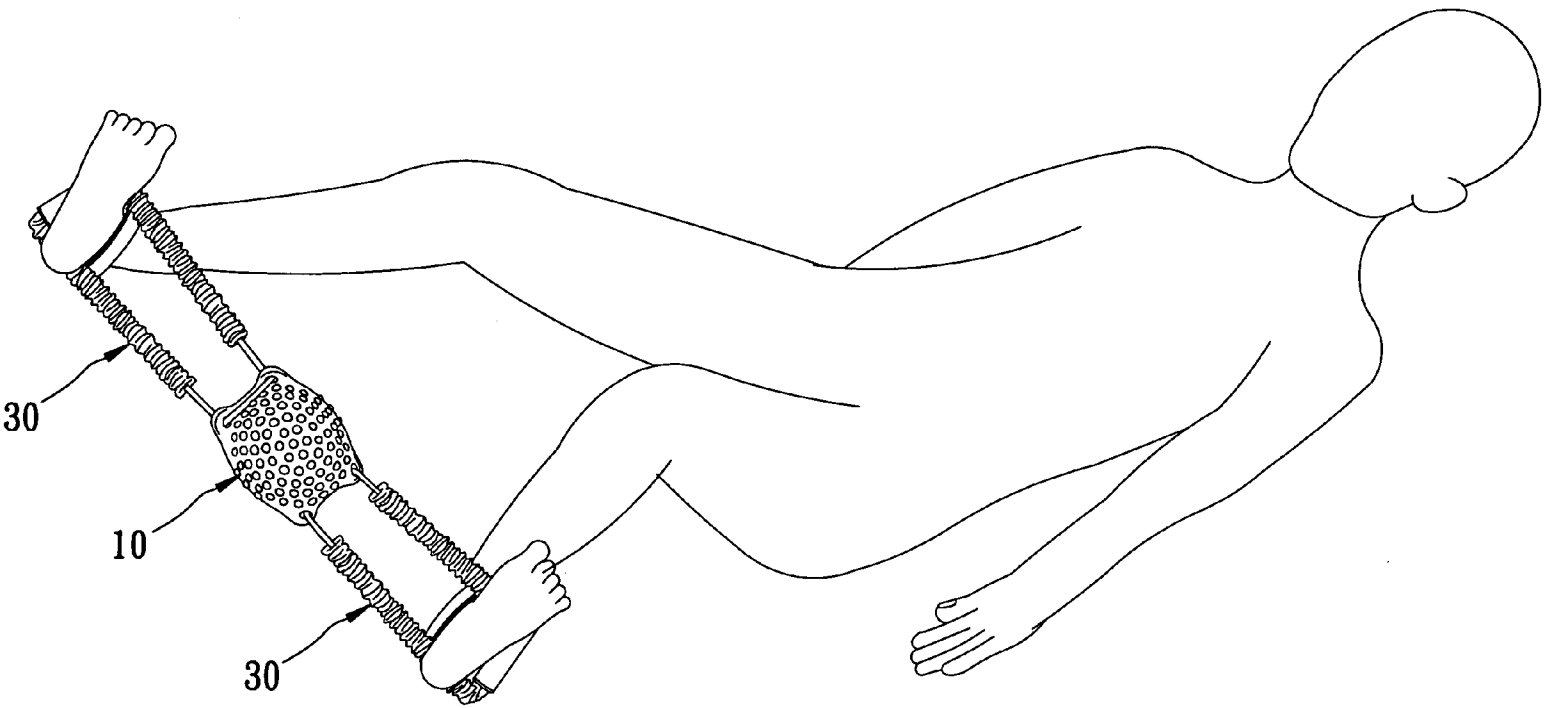

12. The exercise shown in FIG. 15 is substantially similar to the exercise shown in FIG. 13. However, in this exercise, the user lies flatly down on the floor, and repeatedly performs opening and closing of the feet so that building of the leg and waist strengths of the user can be effected.

13. An additional exercise substantially similar to the exercise shown in FIG. 5 can also be performed. However, in this exercise, the arms of the user stretch the pulling units 30 in opposite upward and downward directions until the arms are straight and exert forces so as to repeatedly vibrate the ball body 10 in leftward and rightward directions. As such, exercising of the muscles of the user's arms can be attained.

Thus, the advantages of the present invention can be summarized as follows:

1. Through coordination of the ball body 10, the pulling units 30, and the filler 20, the user can proceed with various exercises, thereby achieving exercising his/her different body parts. Thus, the exercising range of the exercising device of the present invention can be widened, and its operating methods variable.

2. Selecting different kinds of filler 20 to fill the ball body 10 can produce weight adjustment effect and different exercising effects. For example, for simple counterweight requirement, the ball body 10 can be filled with sand or liquid; for flexibility requirement, the ball body 10 can be filled with liquid, air, or a mixture of air and liquid or air and sand. As such, the exercising device of the present invention is convenient to use.

3. The volume of the ball body 10 can be adjusted according to the exercise requirement of the user. When the filler 20 is liquid, filling and emptying of the ball body 10 can be done anytime so that the exercising device of the present invention is easy to carry and store.

4. When the filler 20 is sand, during exercise, the sand rolls inside the ball body 10 and produces sound, which provides the user with a rhythmic feeling.

5. The cord members 31 are covered with fabric covers 34, which can increase feeling of comfort and enhance appearance of the exercising device of the present invention.

6. The ball body 10 is light and does not hinder body movement during exercise. Moreover, the area of the ball body 10 is small when stored.

7. The outer wall surface 112 of the ball body 10 is provided with massage projections 115, which not only can effect massaging action, but can also effectively enhance appearance and strengthen the structure of the exercising device of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An exercising device comprising:

a ball body made of a resilient deformable material, and having a peripheral wall and a receiving space defined by the peripheral wall, the peripheral wall having a largest diameter not larger than 12 inches, an inner wall surface adjacent to the receiving space, an outer wall surface opposite to the inner wall surface, a filling hole extending from the outer wall surface to the inner wall surface and in fluid communication with the receiving space, at least two ear portions protruding outwardly from the outer wall surface, and a valve member inserted detachably into the filling hole to prevent leakage through the filling hole;

a predetermined volume of filler introduced into the receiving space through the filling hole; and two pulling units, each of the pulling units having a positioning strap connected adjustably to the handgrip and each of which includes an elastic cord member that has a connecting end connected to a respective one of the ear portions and an operating end opposite to the connecting end, and a handgrip connected to the operating end of the cord member, wherein the positioning strap has a first end provided with a ring member, a second end opposite to the first end and provided with a first fastening unit, and an intermediate section between the first and second ends and provided with a second fastening unit, the positioning strap being inserted into the handgrip in such a manner that the ring member and the first and second fastening units are disposed outside of the handgrip, the second end extending through the ring member and being folded back to the intermediate section to engage the first fastening unit with the second fastening unit.

2. The exercising device as claimed in claim 1, wherein the outer wall surface of the peripheral wall is provided with a plurality of massage projections.

3. The exercising device as claimed in claim 1, wherein the filler is selected from a group consisting of sand, air and liquid.

4. The exercising device as claimed in claim 1, wherein the filler is selected from a group consisting of a mixture of any two of sand, air and liquid.

5. The exercising device as claimed in claim 1, wherein each of the pulling units further has a fabric cover covering the cord member.

* * * * *